US005468585A

United States Patent [19]

Matsumoto et al.

[11] Patent Number: 5,468,585

[45] Date of Patent: Nov. 21, 1995

[54] RESIN COMPOSITION FOR USE IN AN ELECTROPHOTOGRAPHIC TONER

[75] Inventors: Katsuru Matsumoto, Yokosuka; Nobuhiro Hirayama, Hiratsuka; Shoji Kawasaki, Yokohama; Kenji Uchiyama, Odawara; Katsuo Uramoto; Tamami Fukui, both of Yokohama, all of Japan

[73] Assignee: Mitsui Toatsu Chemicals, Incorporated, Tokyo, Japan

[21] Appl. No.: 363,267

[22] Filed: Dec. 23, 1994

[30] Foreign Application Priority Data

Dec. 24, 1993 [JP] Japan ..... 5-326852
Jul. 28, 1994 [JP] Japan ..... 6-176764

[51] Int. Cl.[6] ..... G03G 9/097; G03G 9/087

[52] U.S. Cl. ..... 430/110; 430/109; 430/111; 525/213; 525/217; 525/218; 525/221; 525/222

[58] Field of Search ..... 430/109, 110, 430/111; 525/213, 217, 218, 221, 222

[56] References Cited

U.S. PATENT DOCUMENTS

| | | | |
|---|---|---|---|
| 4,727,010 | 2/1988 | Shin et al. | 430/120 |
| 4,968,574 | 11/1990 | Morita et al. | 430/111 X |
| 4,973,538 | 11/1990 | Suzuki et al. | 430/109 X |
| 4,990,424 | 2/1991 | Van Dusen et al. | 430/110 X |
| 5,001,031 | 3/1991 | Yamamoto et al. | 430/111 X |
| 5,051,331 | 9/1991 | Sakashita | 430/109 X |
| 5,242,777 | 9/1993 | Kato et al. | 430/109 |
| 5,342,722 | 8/1994 | Ito et al. | 430/111 X |
| 5,362,595 | 11/1994 | Hirayama et al. | 430/137 |
| 5,389,483 | 2/1995 | Kawasaki et al. | 430/110 X |

FOREIGN PATENT DOCUMENTS

| | | |
|---|---|---|
| 323513 | 7/1989 | European Pat. Off. . |
| 323512 | 7/1989 | European Pat. Off. . |
| 322456 | 7/1989 | European Pat. Off. . |
| 568309 | 11/1993 | European Pat. Off. . |
| 619527 | 10/1994 | European Pat. Off. . |

OTHER PUBLICATIONS

Patent Abstracts of Japan, vol. 10, No. 312 (p. 509), Oct. 23, 1986 & JP-A-61 123856 (Canon) * abstract *.

*Primary Examiner*—Roland Martin
*Attorney, Agent, or Firm*—Oblon, Spivak, McClelland, Maier & Neustadt

[57] ABSTRACT

A resin composition for use in an electrophotographic toner which comprises an ethylenic polymer (L) having a $M_w$ of not greater than 20,000 and an acid value of 2 to 100 mg KOH/g, and an ethylenic polymer (H) having a $M_w$ of not less than 150,000, a $M_w/M_n$ ratio of not less than 5.0 and a time constant for triboelectric charging ($\tau$) of 1.2 to 25, the ethylenic polymers (L) and (H) being present in a weight ratio ranging from 15:85 to 85:15. This resin composition can improve the triboelectric charging properties of the toner.

7 Claims, No Drawings

RESIN COMPOSITION FOR USE IN AN ELECTROPHOTOGRAPHIC TONER

BACKGROUND OF THE INVENTION

1. Field of the Invention

This invention relates to a resin composition for use in an electrophotographic toner which serves to develop an electrostatic image in electrophotography, electrostatic recording, electrostatic printing and the like.

2. Description of the Related Art

Conventionally, it has been proposed in Japanese Patent Laid-Open No. 134861/'80 to use a polymer containing an acid component in a toner composition for the purpose of improving its fixability. However, a toner using such a polymer is subject to the influence of environmental variations in that insufficient electric charges tend to be produced under high-humidity conditions and excessive electric charges tend to be produced under low-humidity conditions. Moreover, this toner is also undesirable from the viewpoint of triboelectric charging properties in that it is liable to fogging and suffers from a low image density.

Moreover, several applications of a polymer containing an acid anhydride in order to solve this problem are disclosed in Japanese Patent Laid-Open Nos. 123856/'86 and 280758/'87. In such a polymer containing an acid anhydride as a constituent unit, however, the acid anhydride is not uniformly dispersed in the polymer. Thus, the toner particles cannot be evenly charged, resulting in liability to fogging and poor developability.

Furthermore, in order to compensate for the undesirable properties of acid anhydrides, Japanese Patent Laid-Open No. 181263/'92 (EP 427275A) discloses a technique for preparing a toner having excellent triboelectric charging properties in which a polymer is formed by using an acid anhydride and an unsaturated carboxylic acid as copolymerizable monomers in such proportions as to give a specific acid value. However, since this technique uses a magnetic powder, the disposal of any discarded toner is troublesome. Moreover, since no technical measure is taken against the offset phenomenon and the acid monomers have poor dispersibility, this technique has the disadvantage that the carrier is liable to contamination when used in two components system, and the components used to improve triboelectric charging properties does not work effectively.

Furthermore, a charge controlling agent (CCA) has been used to improve the quantity of electric charge and triboelectric charging speed of toners. However, many of them contain a heavy metal and are highly toxic, and they are expensive. For these reasons, there is a recent tendency to reduce the amount of CCA added to the toner or replace it by a charge controlling agent consisting essentially of a resin (referred to as CCR). For example, Japanese Patent Laid-Open No. 15858/'91 discloses a process for the preparation of a polymeric toner using, as binder resin, a polymer composed of a styrene monomer and 2-acrylamido-2-methylpropanesulfonic acid and having a $M_w$ of 2,000 to 15,000. Japanese Patent Laid-Open No. 56974/'91 discloses a technique for the preparation of a negatively charged toner using, as binder resin, a polymer composed of a styrene monomer, 2-acrylamido-2-methylpropanesulfonic acid and other specific monomers and having a $M_w$ of 2,000 to 15,000. Japanese Patent Laid-Open No. 257461/'91 discloses a technique for the preparation of a magnetic toner containing a charge controlling agent comprising a polymer having a low molecular weight of 1,000 to 20,000.

In these techniques, however, the amount of charge controlling agent used cannot be reduced sufficiently and, moreover, other properties desired for toners cannot be achieved satisfactorily.

SUMMARY OF THE INVENTION

It is an object of the present invention to provide a resin composition for use in an electrophotographic toner which, even when used in a toner containing no charge controlling agent or a reduced amount of charge controlling agent, can impart thereto a high triboelectric charging speed and a sufficient quantity of electric charge.

The above-described object of the present invention is accomplished by a resin composition for use in an electrophotographic toner which comprises an ethylenic polymer (L) having a weight-average molecular weight ($M_w$) of not greater than 20,000, preferably not greater than 10,000, and an acid value of 2 to 100 mg KOH/g, preferably 5 to 30 mg KOH/g, and an ethylenic polymer (H) having a time constant ($\tau$) of 1.2 to 25, preferably 1.2 to 18, as obtained from the following equation (1) for defining the triboelectric charging speed, a weight-average molecular weight ($M_w$) of not less than 150,000, preferably not less than 300,000, and a $M_w$ to number-average molecular weight ($M_n$) ratio (Mw/Mn) of not less than 5.0.

$$Q=(Q_{max})\times(1-\exp(-t/\tau)) \quad (1)$$

where t: Mixing time for triboelectric charging (min)

$\tau$: Time constant for triboelectric charging (min)

Q: Quantity of electric charge (μC/g) at the mixing time for triboelectric charging (t)

$Q_{max}$: Maximum quantity of electric charge (μC/g)

In contrast to prior art techniques, the resin composition for use in an electrophotographic toner in accordance with the present invention can impart adequate triboelectric charging properties (e.g., charge stability and triboelectric charging speed) to toner compositions containing no charge controlling agent (CCA) or a reduced amount of CCA.

DESCRIPTION OF THE PREFERRED EMBODIMENTS

The resin composition for use in an electrophotographic toner in accordance with the present invention has two principal components comprising an ethylenic polymer (H) and an ethylenic polymer (L). Although no particular limitation is placed on the amounts of ethylenic polymer (H) and ethylenic polymer (L) used, they are usually used in a weight ratio of 15:85 to 85:15 and preferably 30:70 to 70:30.

The ethylenic polymer (L) should have a $M_w$ of not greater than 20,000 and preferably between 500–10,000. If its $M_w$ is greater than 20,000, it will be difficult to obtain fixability at sufficiently low temperatures. Moreover, the toner will become excessively hard, resulting in reduced productivity.

The ethylenic polymer (L) also should have an acid value of 2 to 100 mg KOH/g and preferably 5 to 30 mg KOH/g. The acid value needs to be kept within these limits in order to achieve charge stability to humidity and retain the absolute quantity of electric charge. Preferably, the monomer used to keep the acid value within these limits is an acid monomer having an acid dissociation constant (pKa) of 6.5 or less. As used herein, pKa is a value obtained by preparing an ethanolic solution of an acid monomer having a molar concentration of 1.0 mol/l and measuring the pKa of this sample solution with a pH meter. In the present invention, an acid monomer having a pKa of 6.5 or less is preferably used to form an ethylenic polymer (L) having an acid value of 2 to 100 mg KOH/g, because the toner prepared therefrom is highly desirable from the viewpoint of charge stability to humidity and, moreover, fixability.

The ethylenic polymer (H) should have a time constant for triboelectric charging ($\tau$) of 1.2 to 25.0 and preferably 1.2 to 18.0. More specifically, the quantity of electric charge (Q) at any given mixing time for triboelectric charging (t) can be determined according to the following equation (1). In this equation, smaller values of the time constant ($\tau$) represent higher triboelectric charging speeds.

$$Q=(Q_{max})\times(1-\exp(-t/\tau)) \quad (1)$$

where t: Mixing time for triboelectric charging (min)

$\tau$: Time constant for triboelectric charging (min)

Q: Quantity of electric charge ($\mu$C/g) at the mixing time for triboelectric charging (t)

$Q_{max}$: Maximum quantity of electric charge ($\mu$C/g)

In order to keep the time constant for triboelectric charging ($\tau$) within the range of 1.2 to 25.0, it is desirable to use a monomer having a large dipole moment and, moreover, localize it as a constituent of the polymer. To this end, it is preferable to prepare the ethylenic polymer (H) with due consideration for the reactivity ratio of monomers and polymerization techniques. From this point of view, it is preferable that the monomer has an ionization potential (IP) of 11.20 eV or greater and a work function (WF) of 6.1 eV or greater.

Moreover, the ethylenic polymer (H) should have a $M_w$ of not less than 150,000 and preferably in the range of 300,000 to 1,000,000, and a weight-average molecular weight ($M_w$) to number-average molecular weight ($M_n$) ratio ($M_w/M_n$) of not less than 5.0 and preferably in the range of 5.0 to 100. By keeping its molecular weight within the aforesaid limits, good offset resistance can be imparted to the toner.

In the present invention, the strength of a resin is evaluated on the basis of the average particle diameter obtained after jet pulverization. More specifically, the particle size of a test resin is preadjusted so that the particles pass through a 10 mesh screen but are retained on a 16 mesh screen. Using a collision plate type jet pulverizer (Labojet, manufactured by Japan Pneumatic MFG., Ltd.), this test resin is pulverized under conditions including a jet stream pressure of 3 kg/cm$^2$, a resin feed rate of 10 g/min, and a clearance height of 10 mm. Then, the average particle diameter of the pulverized resin is measured with a Coalter counter. When evaluated in this manner, the strength of the resin mixture of the ethylenic polymers (H) and (L) should preferably be such that the particle diameter is in the range of 15.0 to 42.0 $\mu$m. By adjusting the strength of the resin so that the particle diameter is kept within the aforesaid range, the productivity of the toner and the amount of energy consumed in the coarse grinding and pulverizing steps of the toner production process can be optimized. If the particle diameter is smaller than 15.0 $\mu$m, the resulting toner will have poor durability and tend to be scattered in the machine with the lapse of time. If the particle diameter is larger than 42.0 $\mu$m, the resulting resin composition and the toner prepared therefrom have such poor pulverizability as to cause a marked reduction in productivity and an increase in energy consumption.

Moreover, a toner having more desirable fixability and anti-blocking properties (non-cohesiveness) can be obtained by determining the difference between the glass transition temperature (TgL) of the ethylenic polymer (L) and the glass transition temperature (TgH) of the ethylenic polymer (H) so as to be in the range of 5.0° to 22.5° C. It is desirable that the TgL is in the range of 55.0° to 76.5° C.

The monomers which can constitute the ethylenic polymer (H) and the ethylenic polymer (L) include, but not limited to, aromatic vinyl monomers such as styrene, $\alpha$-methylstyrene, halogenated styrenes, vinyltoluene, divinylbenzene, 4-sulfonamidostyrene and 4-styrenesulfonic acid; (meth)acrylic esters such as methyl (meth)acrylate, ethyl (meth)acrylate, propyl (meth)acrylate, n-butyl (meth)acrylate, isobutyl (meth)acrylate, octyl (meth)acrylate, dodecyl (meth)acrylate, lauryl (meth)acrylate, stearyl (meth)acrylate, cyclohexyl (meth)acrylate, phenyl (meth)acrylate, benzyl (meth)acrylate, furfuryl (meth)acrylate, hydroxyethyl (meth)acrylate, hydroxybutyl (meth)acrylate, dimethylaminomethyl (meth)acrylate, dimethylaminoethyl (meth)acrylate, 2-ethylhexyl (meth)acrylate, 2-chloroethyl (meth)acrylate and acetoacetoxyethyl (meth)acrylate; itaconic esters such as dimethyl itaconate, dipropyl itaconate, butyl itaconate, dioctyl itaconate and diamyl itaconate; unsaturated carboxylic acids and unsaturated dicarboxylic acids such as (meth)acrylic acid, cinnamic acid, maleic acid, fumaric acid and itaconic acid; and other ethylenically unsaturated compounds such as 2-vinylnaphthalene, itaconic anhydride, N,N-dimethylacrylamide, acrylamide and methacrylamide.

Although the ethylenic polymers (H) and (L) may be prepared to any conventional polymerization process, it is preferable to prepare them by bulk polymerization process and/or solution polymerization.

In the present invention, a resin composition for use in an electrophotographic toner which comprises an ethylenic polymer (L) having an acid value of 5 to 30 mg KOH/g and a $M_w$ of not greater than 20,000 (in particular, not greater than 10,000), and an ethylenic polymer (H) composed of 40 to 90 parts by weight of an aromatic vinyl monomer, 1 to 20 parts by weight of maleic anhydride and 5 to 40 parts by weight of a fumaric diester or maleic diester and having a $M_w$ of not less than 300,000 (in particular, between 300,000–1,000,000) is especially preferred. When the ethylenic polymer (H) has the above-described monomer composition, the time constant for triboelectric charging ($\tau$) can readily be kept within the range defined by the present invention.

Moreover, it is preferable that the overall acid value of the resin mixture of the ethylenic polymers (H) and (L) is in the range of 20 to 100 mg KOH/g and the acid value based on the maleic anhydride in the ethylenic polymer (H) is in the range of 6 to 85 mg KOH/g. It is especially preferable that the overall acid value of the resin mixture is in the range of 30 to 90 mg KOH/g and the acid value based on the maleic anhydride in the ethylenic polymer (H) is in the range of 25 to 70 mg KOH/g.

The main purpose of the use of a fumaric diester or a maleic diester is to control the glass transition temperature (Tg) of the resin. Moreover, such monomers also produce an important effect in that they do not interfere with the very effective negative charging properties possessed by maleic anhydride, but rather bring about a further improvement in charging properties on the basis of a synergistic effect. Useful esters include alkyl esters such as ethyl, propyl, butyl, pentyl, hexyl, heptyl and octyl. Among others, fumaric diesters having $C_4$ or longer ester chains are particularly effective. Maleic diesters are less preferable than fumaric diesters in that it is difficult to achieve high molecular weights. The use of a monoester has the disadvantage that a sufficient quantity of electric charge cannot be obtained and, moreover, the polymerization cannot be controlled with ease. Preferred examples of such esters include dibutyl fumarate, dipentyl fumarate, dihexyl fumarate, diheptyl fumarate, dioctyl fumarate, ethyl butyl fumarate, ethyl octyl fumarate, butyl octyl fumarate, butyl hexyl fumarate, pentyl octyl fumarate and the like. These fumaric diesters may be used alone or in admixture of two or more.

The resin composition of the present invention is used as a binder for toner. This resin composition is usually used in an amount of 50 to 95% by weight of the toner composition.

If desired, the resin composition can also contain other materials such as polyvinyl chloride, polyolefins, polyesters, polyvinyl butyral, polyurethanes, polyamides, rosin, terpene resin, phenolic resins, epoxy resins and paraffin wax, so far as the effects of the present invention are not interfered with.

Moreover, it is preferable that the resin composition additionally contains a specific additive comprising one or more compounds selected from acetanilide, benzenesulfonamide, 4-amidophenol, 4-acetamidothiophenol, phenylurea, 3-nitrobenzamide, 4-methoxybenzamide and benzamide. Use of this specific additive optimizes the balance between the melt flowability and glass transition temperature (Tg) of the resin composition. In other words, melt flowability having a significant effect on fixability can further be improved with the retention of a high Tg which greatly influences antiblocking properties (generally, a resin having a high Tg exhibits good anti-blocking properties). That is, a resin having excellent anti-blocking properties and capable of providing low-temperature fixability can be obtained. Of the foregoing compounds, acetanilide is most preferred. The above-described specific additive is preferably used in an amount of 1.0 to 15 parts by weight per 100 parts by weight of the binder resin. If its amount is less than 1.0 part by weight, the additive will fail to produce a satisfactory effect. If its amount is greater than 15 parts by weight, the additive will be so poorly dispersed that the concentration of the additive may vary among toner particles, thus exert adverse influences such as the production of reverse charge and a widening of the charge distribution. The methods for incorporating the specific additive into the binder resin include, but not limited to, adding the specific additive in the step of mixing a solution of the ethylenic polymer (H) and a solution of the ethylenic polymer (L) and removing the solvent from the resulting mixture, or adding the specific additive in the premixing or melt kneading step for mixing the binder resin, colorant and other ingredients desired for the toner.

Furthermore, in order to improve the properties of the resulting toner, a low-molecular-weight polyolefin wax may be added to the resin composition. This low-molecular-weight polyolefin wax may be an unmodified polyolefin wax or a modified polyolefin wax having a modifying component block- or graft-copolymerized with the olefin component.

It is desirable that such unmodified and modified polyolefin waxes themselves have a low softening point. For example, it is desirable that, when measured according to the ring and ball method described in JIS K 2531-1960, their softening points are in the range of 80° to 180° C. and preferably 90° to 160° C. Specific examples of such polyolefin waxes include commercial products such as "Biscol 660P" and "Biscol 550P" (manufactured by Sanyo Chemical Industries Ltd.); "Polyethylene 6A" (manufactured by Allied Chemical Corp.); "Hiwax 400P", "Hiwax 100P", "Hiwax 200P", "Hiwax 320P", "Hiwax 220P", "Hiwax 2203P" and "Hiwax 4202P" (manufactured by Mitsui Petrochemical Industries, Ltd.); "Hoechst Wax PE520", "Hoechst Wax PE130" and "Hoechst Wax PE190" (manufactured by Hoechst Japan Ltd.); and the like. Other specific examples include polyethylene wax having methyl methacrylate block- or graft-copolymerized therewith, polyethylene wax having butyl methacrylate block- or graft-copolymerized therewith, polyethylene wax having styrene block- or graft-copolymerized therewith, and the like. These polyolefin waxes are usually mixed with the resin composition in the melt kneading step of the toner production process. However, they may be added during polymerization or solvent removal of the ethylenic polymer (L) or (H).

In electrophotographic toner compositions using the resin composition of the present invention, a colorant is usually used. Usable colorants include, for example, black pigments such as carbon black, acetylene black, lamp black and magnetite; and other conventional pigments such as chrome yellow, yellow iron oxide, Hansa Yellow G, Quinoline Yellow Lake, Permanent Yellow, NCG Molybdenum Orange, Vulcan Orange, indanthrene, Brilliant Orange GK, red iron oxide, Brilliant Carmine 6B, alizarin lake, Fast Violet B, cobalt blue, Alkali Blue Lake, Phthalocyanine Blue, metal complexes of monoazo dyes, Fast Sky Blue, Pigment Green B, Malachite Green Lake, titanium oxide and zinc white. The amount of colorant used is usually in the range of 5 to 300 parts by weight per 100 parts by weight of the resin composition. When the resin composition of the present invention is used, it is usually unnecessary to use a charge controlling agent such as a metal-containing azo dye or a metal salt of a fatty acid. If desired, however, such a charge controlling agent may be used in an amount of less than 2.0 parts by weight based on the total weight of the toner composition. Moreover, any suitable pigment dispersant, anti-offset agent and the like may be chosen and added thereto.

The resin composition containing the above-described various additives is premixed in a Henschel mixer and then kneaded in a heated and melted state by means of a kneader or the like. After cooling, the resin composition is pulverized with a jet pulverizer and then classified with a classifier. Usually, particles having a size in the range of 8.0 to 20.0 μm are collected to obtain a toner.

In order to obtain a magnetic toner, a magnetic powder may be incorporated into the toner. Useful magnetic powders include powders of ferromagnetic substances which are magnetized in a magnetic field, i.e., such metals as iron, nickel and cobalt, and such alloys as magnetite and ferrite. Such a magnetic powder is preferably used in an amount of 15 to 70% by weight of the toner.

Moreover, in the practice of the present invention, a mold release agent as described below may be suitably used at the time of polymerization or melt kneading. The term "mold release agent" as used herein means any substance that comes into contact with a fixing roller at the time of fixing and thereby performs the functions of decreasing friction, improving mold release properties, or improving melt flowability. Useful mold release agents include, for example, higher (saturated straight-chain) fatty acids (having 12 to 50 carbon atoms), higher alcohols (having 8 to 32 carbon atoms), metallic salts of fatty acids, fatty acid amides, metallic soaps and polyhydric alcohols.

Furthermore, a powder flow improver such as fine teflon powder may be incorporated into the toner in order to prevent cohesion of toner particles and thereby improve its powder flowability.

The present invention is further illustrated by the following examples. However, these examples are not to be construed to limit the scope of the invention. Unless otherwise stated, all parts are by weight.

PREPARATION EXAMPLES 1–11

[Preparation of ethylenic polymers (H)]

A 5-liter four-necked flask fitted with a cooling coil, a thermometer, a nitrogen inlet tube and a stirring device was charged with 89.2 parts of styrene and 10.8 parts of acetoacetoxyethyl methacrylate. This mixture was heated to an internal temperature of 120° C. and held at that temperature for 6.5 hours to effect bulk polymerization. After the addition of 100.0 parts of xylene, a solution previously prepared by dissolving 0.3 part of t-butyl peroxide in 50.0 parts of xylene was continuously added dropwise thereto at 130° C. over a period of 6.5 hours. Thereafter, the reaction was continued for an additional hour to complete the polymerization and thereby obtain polymer 1.

Polymers 2–11 were prepared in the same manner as in Preparation Example 1, except that the respective preparation conditions shown Table 1 were employed.

PREPARATION EXAMPLES 12–17

[Preparation of ethylenic polymers (L)]

A 5-liter four-necked flask fitted with a cooling coil, a thermometer, a nitrogen inlet tube and a stirring device was charged with 150 parts of xylene solvent. After this solvent was heated to the reflux temperature with the introduction of nitrogen, a mixed solution composed of 89.5 parts of styrene, 7.0 parts of methacrylic acid, 3.5 parts of n-butyl acrylate and 10.0 parts of t-butyl peroxy-2-ethylhexanoate was continuously added dropwise thereto over a period of 6.5 hours, followed by postpolymerization. Thereafter, the residual monomers were polymerized to obtain polymer 12.

Polymers 13–17 were prepared in the same manner as in Preparation Example 12, except that the respective preparation conditions shown Table 2 were employed.

Properties of the ethylenic polymers (L) and (H) obtained in the foregoing preparation examples were determined as follows.

(a) Molecular weight

Employing a commercially available monodisperse standard polystyrene as the reference standard, the molecular weight of each ethylenic polymer was determined by GPC using tetrahydrofuran as the solvent and a refractometer as the detector.

Detector: SHODEX RI SE-31.

Column: A-80M×2+KF-802

Solvent: THF (tetrahydrofuran)

Discharge rate: 1.2 ml/min.

Sample: 0.25% solution in THF.

(b) Acid value

An accurately weighed sample was dissolved in a neutralized solvent mixture of xylene and n-butanol, and this solution was titrated with a previously standardized 0.1N alcoholic solution of potassium hydroxide (KOH). Then, its neutralization value was calculated according to the following equation.

$$\text{Acid value} = \frac{\text{Alcohol solution of KOH (ml)} \times F \times 56.1}{\text{Sample (g)} \times \text{Nonvolatile content (\%)} \times 0.01}$$

where F is a factor for the 0.1N alcoholic solution of KOH.

(C) Quantity of electric charge

Using a commercially available grinder, each ethylenic polymer was reduced to a powder having a particle diameter of 3 mm or less. Then, using a collision plate type jet pulverizer, this powder was pulverized so as to give a 50% volume-average particle diameter of 25 μm or less. Thereafter, a sample (R) for the measurement of electric charge having a volume-average particle diameter of 5 to 25 μm was obtained with the aid of an air classifier. This sample was mixed with silicon-coated iron powder carrier (C) in a ratio of 98:2 (C/R=98/2). While this mixture was mixed at a temperature of 22° C. and a relative humidity of 55% by means of a Turbler shaker-mixer, a series of samples were taken at suitable intervals of time and their quantities of electric charge were measured with a blow-off electric charge measuring instrument.

(d) Time constant for triboelectric charging (τ)

A plot was made according to the following equation (2) which is a modification of the equation (1) for defining the triboelectric charging speed. Then, the time constant (τ) was determined from its slope.

$$(t/\tau) = -\ln(1 - Q/Q_{max}) \quad (2)$$

EXAMPLES 1–16 AND COMPARATIVE EXAMPLES 1–5

Solutions of the ethylenic polymers (H) obtained as above and solutions of the ethylenic polymers (L) obtained as above were mixed in various combinations and freed of solvent to obtain a variety of binder resins.

Then, 100 parts of each binder resin, 10 parts of carbon black, 5 parts of polypropylene wax and other desired ingredients were premixed in a Henschel mixer and kneaded at 170° C. in a double-shaft kneader. Thereafter, this mixture was cooled, coarsely ground, pulverized and then classified with a classifier to obtain a toner having a particle diameter of 5.0 to 25.0 μm.

Using the toners thus obtained, fixability, hot offset resistance, triboelectric charging speed and other properties were evaluated.

Fixability and hot offset resistance were evaluated by means of a commercially available copying machine which had been modified so that the roll temperature could be altered at will. The procedures for evaluation are given below.

(i) Fixability

Using a JSPSR type rubbing tester (manufactured by Daiei Kagaku Seiki Seisakusho), the toner layer formed on a 2 cm×2 cm black solid square was rubbed 50 times with a sand eraser under a load of 250 g/cm$^2$. Then, its optical density was measured with an ink densitometer. Fixability was evaluated on the basis of the minimum hot roll temperature required to cause the optical density to exceed 70%.

(ii) Offset resistance

By raising the hot roll temperature gradually, offset resistance was evaluated on the basks of the temperature at which the offset phenomenon began to occur.

(iii) Triboelectric charging speed

Using a Turbler shaker-mixer, 1 g of each toner and 49 g of iron powder carrier (F95-100, manufactured by Powdertech Co., Ltd. ) were mixed and agitated for 1 minute or 60 minutes. Then, the quantity of electric charge was measured with a blow-off electric charge measuring instrument (manufactured by Toshiba Chemical Corp.). Triboelectric charging speed was evaluated on the basis of the ratio of the quantity of electric charge measured after 60 minutes of mixing and agitation (referred to as Q60) to the quantity of electric charge measured after 1 minute of mixing and agitation (referred to as Q1).

$$T=Q60/Q1$$

○: $T<2.0$

Δ: $2.0<T\leqq 3.5$ x: $3.5<T$ (iv) Charge stability to humidity

The quantity of electric charge produced under low-temperature and low-humidity conditions (15° C., 35%) (referred to as QLL) and the quantity of electric charge produced under high-temperature and high-humidity conditions (35° C., 75%) (referred to as QHH) were measured. Then, charge stability to humidity was evaluated on the basis of the ratio (absolute value) defined by the following equation.

$$S=(QLL-QHH)/QLL$$

○: $S\leqq 0.2$

Δ: $0.2<S\leqq 0.4$ x: $0.4<S$ (v) Toner productivity

When a toner was prepared according to the above-described process, its productivity was evaluated on the basis of tile feed rate of a sample which had to be fed to tile pulverization step in order to keep the particle diameter of tile toner within the above-defined limits. Higher feed rates indicate better results.

The results of evaluation of the above-described toner properties are shown in Table 3.

TABLE 1

Preparation of Ethylenic Polymers (H)

| Preparation Example No. | 1 | 2 | 3 | 4 | 5 | 6 | 7 | 8 | 9 | 10 | 11 |
|---|---|---|---|---|---|---|---|---|---|---|---|
| Polymer No. | 1 | 2 | 3 | 4 | 5 | 6 | 7 | 8 | 9 | 10 | 11 |
| Bulk polymerization | | | | | | | | | | | |
| Styrene | 89.2 | 82.5 | 82.5 | 80.0 | 69.6 | 62.2 | 82.5 | 56.1 | 82.5 | 82.5 | 82.5 |
| Di-n-butyl fumarate | 0.0 | 0.0 | 0.0 | 20.0 | 0.0 | 0.0 | 0.0 | 0.0 | 0.0 | 0.0 | 0.0 |
| Maleic anhydride | 0.0 | 6.0 | 6.0 | 6.0 | 15.0 | 15.0 | 6.0 | 25.0 | 0.0 | 0.0 | 0.0 |
| Monobutyl maleate | | | | | | | | 0.0 | 0.0 | 0.0 | 0.0 |
| Dibutyl maleate | | | | | | | | 0.0 | 0.0 | 0.0 | 0.0 |
| Dioctyl fumarate | 0.0 | 11.5 | 11.5 | 0.0 | 16.5 | 22.8 | 11.5 | 18.9 | 11.5 | 11.5 | 11.5 |
| Acetoacetoxyethyl methacrylate | 10.8 | 0.0 | 0.0 | 0.0 | 0.0 | 0.0 | 0.0 | | | | |
| Polymerization temperature (°C.) | 120 | 110 | 110 | 110 | 110 | 110 | 110 | 110 | 110 | 110 | 110 |
| Polymerization time (h) | 6.5 | 7.0 | 7.0 | 7.0 | 7.0 | 7.0 | 7.0 | 7.0 | 7.0 | 7.0 | 7.0 |
| Dilution Xylene | 100.0 | 70.0 | 70.0 | 70.0 | 70.0 | 70.0 | 70.0 | 70.0 | 70.0 | 70.0 | 70.0 |
| Addition | | | | | | | | | | | |
| Divinyl benzene | 0.0 | 0.2 | 0.2 | 0.2 | 0.2 | 0.2 | 0.2 | 0.2 | 0.2 | 0.2 | 0.2 |
| Maleic anhydride | | | | | | | | 0.0 | 6.0 | 0.0 | 0.0 |
| Solution Polymerization | | | | | | | | | | | |
| Xylene | 50.0 | 30.0 | 30.0 | 30.0 | 30.0 | 30.0 | 30.0 | 30.0 | 30.0 | 30.0 | 30.0 |
| t-Butyl peroxide | 0.3 | 0.3 | 0.3 | 0.3 | 0.3 | 0.3 | 0.3 | 0.3 | 0.3 | 0.3 | 0.3 |
| Divinylbenzene | 0.0 | 0.1 | 0.1 | 0.1 | 0.1 | 0.1 | 0.1 | 0.1 | 0.1 | 0.1 | 0.1 |
| Maleic anhydride | | | | | | | | 0.0 | 0.0 | 6.0 | 6.0 |
| Dibutyl maleate | | | | | | | | 0.0 | 0.0 | 0.0 | 6.0 |
| Polymerization temperature (°C.) | 130 | 130 | 130 | 130 | 130 | 130 | 130 | 130 | 130 | 130 | 130 |
| Dropping time (h) | 6.5 | 7.0 | 12.5 | 7.0 | 7.0 | 7.0 | 7.0 | 7.0 | 7.0 | 7.0 | 7.0 |
| $M_w \times 10^4$ | 30.4 | 35.5 | 48.2 | 33.0 | 39.9 | 41.8 | 12.2 | 34.9 | 30.9 | 31.8 | 32.6 |
| Acid value (mg KOH/g) | 0 | 58.2 | 55.4 | 59.1 | 134.1 | 126.5 | 57.2 | 235.4 | 58.2 | 54.2 | 55.6 |
| Time constant (min) | 16.4 | 8.4 | 6.2 | 10.4 | 3.1 | 4.6 | 8.9 | 2.6 | 6.4 | 5.9 | 16.4 |
| $M_w/M_n$ | 5 or above | 5 or above | 5 or above | 5 or above | 5 or above | 5 or above | 5 or above | 5 or above | 5 or above | 5 or above | 5 or above |

TABLE 2

Preparation of Ethylenic Polymers (L)

| Preparation Example No. | 12 | 13 | 14 | 15 | 16 | 17 |
|---|---|---|---|---|---|---|
| Polymer No. | 12 | 13 | 14 | 15 | 16 | 17 |
| Xylene | 150.0 | 100.0 | 100.0 | 100.0 | 100.0 | 80.0 |
| Stylene | 89.5 | 100.0 | 94.0 | 77.0 | 84.0 | 77.0 |
| Methacrylic acid | 7.0 | 0.0 | 1.0 | 3.0 | 4.0 | 3.0 |
| n-Butyl acrylate | 3.5 | 0.0 | 5.0 | 10.0 | 12.0 | 5.0 |
| Dioctyl fumarate | 0.0 | 0.0 | 0.0 | 0.0 | 0.0 | 0.0 |
| t-Butyl peroxy-2-ethylhexanoate | 10.0 | 10.0 | 10.0 | 10.0 | 10.0 | 10.0 |
| Polymerization temp. (°C.) | Reflux temp. | Reflux temp. | Reflux temp. | Reflux temp. | Reflux temp. | Reflux temp. |
| Dropping time (h) | 6.5 | 6.5 | 6.5 | 6.5 | 6.5 | 6.5 |

TABLE 2-continued

| Preparation of Ethylenic Polymers (L) | | | | | | |
|---|---|---|---|---|---|---|
| Tg (°C.) | 53.8 | 61.4 | 58.2 | 60.1 | 60.5 | 64.1 |
| $M_w$ | 5070 | 6000 | 8000 | 6000 | 6000 | 28000 |
| Acid value (mg KOH/g) | 20.8 | 0 | 6.5 | 19.2 | 26.1 | 18.5 |

TABLE 3

Formulation and Performance of Toners

| Example | Toner | Ethylenic polymer (H) | Ethylenic polymer (L) | Additive Type | Additive Amount parts | Resin strength (μm) | Fixability (°C.) | Offset resistance (°C.) | Tribo-electric charging speed | Charge stability to humidity | Toner product-ivity |
|---|---|---|---|---|---|---|---|---|---|---|---|
| Example 1 | 1 | Polymer 1 | Polymer 12 | | None | 26.2 | 138 | 221 | Δ | ○ | good |
| Example 2 | 2 | Polymer 2 | Polymer 15 | | None | 31.5 | 128 | 227 | ○ | ○ | good |
| Example 3 | 3 | Polymer 3 | Polymer 15 | | None | 30.4 | 132 | 240 | ○ | ○ | good |
| Example 4 | 4 | Polymer 5 | Polymer 15 | | None | 38.1 | 131 | 234 | ○ | ○ | good |
| Example 5 | 5 | Polymer 6 | Polymer 15 | | None | 40.2 | 134 | 238 | ○ | ○ | good |
| Example 6 | 6 | Polymer 2 | Polymer 14 | | None | 35.6 | 124 | 235 | ○ | ○ | good |
| Example 7 | 7 | Polymer 2 | Polymer 16 | | None | 28.6 | 129 | 237 | ○ | ○ | good |
| Example 8 | 15 | Polymer 9 | Polymer 15 | | None | 28.5 | 134 | 248 | ○ | ○ | good |
| Example 9 | 16 | Polymer 10 | Polymer 15 | | None | 27.4 | 133 | 247 | ○ | ○ | good |
| Example 10 | 17 | Polymer 11 | Polymer 15 | | None | 28.9 | 126 | 232 | ○ | ○ | good |
| Example 11 | 8 | Polymer 4 | Polymer 15 | | None | 27.6 | 127 | 235 | ○ | ○ | good |
| Example 12 | 10 | Polymer 8 | Polymer 15 | | None | 34.2 | 133 | 234 | ○ | Δ | good |
| Example 13 | 13 | Polymer 2 | Polymer 15 | A | 2.5 | 31.3 | 123 | 224 | ○ | ○ | good |
| Example 14 | 14 | Polymer 2 | Polymer 15 | A | 5.0 | 30.1 | 119 | 219 | ○ | ○ | good |
| Example 15 | 15 | Polymer 2 | Polymer 15 | A | 20.0 | 29.3 | 109 | 213 | Δ | ○ | good |
| Example 16 | 16 | Polymer 2 | Polymer 15 | A | 5.0 | 32.6 | 122 | 225 | ○ | ○ | good |
| Comparative Example 1 | 9 | Polymer 7 | Polymer 15 | | None | 12.6 | 114 | 183 | X | Δ | poor |
| Comparative Example 2 | 11 | Polymer 2 | Polymer 13 | | None | 28.4 | 131 | 234 | X | Δ | good |
| Comparative Example 3 | 12 | Polymer 2 | Polymer 17 | | None | 39.6 | 156 | 248 | X | X | poor |
| Comparative Example 4 | 13 | Polymer 4 | Polymer 13 | | None | 31.6 | 137 | 224 | X | X | good |
| Comparative Example 5 | 14 | Polymer 4 | Polymer 17 | | None | 45.6 | 152 | 245 | X | X | poor |

(Notes)
The ethylenic polymers (H) and (L) were mixed in a weight ratio f 50:50. The additives used were acetanilide (A) and benzenesulfonamide (B)

What is claimed is:

1. A resin composition for use in an electrophotographic toner which comprises an ethylenic polymer (L) having a weight-average molecular weight ($M_w$) of not greater than 20,000 and an acid value of 2 to 100 mg KOH/g, and an ethylenic polymer (H) having a time constant (τ) of 1.2 to 25 as obtained from the following equation (1) for defining the triboelectric charging speed, a weight-average molecular weight ($M_w$) of not less than 150,000, and a $M_w$ to number-average molecular weight ($M_n$) ratio ($M_w/M_n$) of not less than 5.0.

$$Q=(Q_{max})\times(1-\exp(-t/\tau)) \quad (1)$$

where t: Mixing time for triboelectric charging (min)

τ: Time constant for triboelectric charging (min)

Q: Quantity of electric charge (μC/g) at the mixing time for triboelectric charging (t)

$Q_{max}$: Maximum quantity of electric charge (μC/g).

2. A resin composition for use in an electrophotographic toner as claimed in claim 1 wherein the ethylenic polymer (L) has a weight-average molecular weight ($M_w$) of not greater than 10,000.

3. A resin composition for use in an electrophotographic toner as claimed in claim 1 wherein the strength of the resin mixture of the ethylenic polymers (L) and (H) is such that, when pulverized with a collision plate type jet pulverizer (under conditions including a jet stream pressure of 3 kg/cm$^2$, a resin feed rate of 10 g/min, and a clearance height of 10 mm), the resin mixture has an average particle size of 15.0 to 42.0 μm.

4. A resin composition for use in an electrophotographic toner as claimed in claim 1 wherein the ethylenic polymer (L) has an acid value of 5 to 30 mg KOH/g and the ethylenic polymer (H) is composed of 40 to 90 parts by weight of an aromatic vinyl monomer, 1 to 20 parts by weight of maleic anhydride and 5 to 40 parts by weight of a fumaric diester or a maleic diester and has a $M_w$ of not less than 300,000.

5. A resin composition for use in an electrophotographic toner which comprises an ethylenic polymer (L) having an acid value of 5 to 30 mg KOH/g and a $M_w$ of not greater than 20,000, and an ethylenic polymer (H) composed of 40 to 90 parts by weight of a styrene monomer, 1 to 20 parts by weight of maleic anhydride and 5 to 40 parts by weight of a fumaric diester or a maleic diester and having a $M_w$ of not less than 300,000.

6. A resin composition for use in an electrophotographic toner as claimed in claims 1 wherein a compound selected from the group consisting of acetanilide, benzenesulfonamide, 4-amidophenol, 4-acetamidothiophenol, phenylurea, 3-nitrobenzamide, 4-methoxybenzamide and benzamide is additionally contained in an amount of 1.0 to 15.0 parts by weight per 100 parts by weight of the combined amount of the ethylenic polymer (L) and the ethylenic polymer (H).

7. An electrophotographic toner containing a resin composition for use in an electrophotographic toner as claimed in any one of claims 1 to 6.

* * * * *